US005573729A

United States Patent [19]

Belgardt et al.

[11] Patent Number: 5,573,729

[45] Date of Patent: Nov. 12, 1996

[54] REPETITION PIPETTE

[75] Inventors: Herbert Belgardt; Klaus Schürbrock, both of Hamburg; Rolf-Günter Meyer, Bendestorf, all of Germany

[73] Assignee: Eppendorf-Netheler-Hinz GmbH, Hamburg, Germany

[21] Appl. No.: 425,521

[22] Filed: Apr. 20, 1995

[30] Foreign Application Priority Data

Apr. 27, 1994 [DE] Germany ..... 44 14 744.9

[51] Int. Cl.[6] ..... B01L 3/02

[52] U.S. Cl. ..... 422/100; 222/287; 222/309; 222/391; 73/864.16; 73/864.18

[58] Field of Search ..... 422/100; 222/287, 222/309, 309 OR, 287 OR, 391, 391 OR; 73/864.16, 864.18

[56] References Cited

U.S. PATENT DOCUMENTS

| | | | |
|---|---|---|---|
| 2,768,768 | 10/1956 | Cornell et al. | 222/80 |
| 4,099,548 | 7/1978 | Sturn et al. | 222/391 |
| 4,406,170 | 9/1983 | Kuhn | 73/864.16 |
| 4,467,942 | 8/1984 | Oshikubo | 222/44 |
| 4,470,317 | 9/1984 | Sabloewski et al. | 73/864.16 |
| 4,581,022 | 4/1986 | Leonard et al. | 222/391 |
| 5,323,931 | 7/1994 | Robards, Jr. et al. | 222/391 |
| 5,330,721 | 7/1994 | Tervamaki | 422/100 |

FOREIGN PATENT DOCUMENTS

| | | |
|---|---|---|
| 2926691 | 6/1981 | Germany . |
| 3216644 | 11/1983 | Germany . |
| 1277450 | 8/1969 | United Kingdom . |

*Primary Examiner*—Jill Warden
*Assistant Examiner*—Sharidan Carrillo
*Attorney, Agent, or Firm*—Anderson, Kill & Olick P.C.

[57] ABSTRACT

A repetition pipette including a syringe receiving section for the mounting portion of a syringe, a receiving member having a piston receiving portion for the mounting portion of a syringe piston, piston returning means for moving said receiving member away from said syringe receiving portion, piston advancing means for advancing said receiving member towards said piston receiving portion, which piston advancing means comprises a rack connected to said receiving member, and actuating element movable along an actuation path, and a pawl pivotally mounted thereto, which pawl is moved into engagement with the toothing of the rack so as to drive the latter for an advancing step when the actuating element is advanced, and is moved out of engagement with the rack when the actuating element is returned, and step width adjusting means for adjusting the step width of the advancing step, the step width adjusting means comprising a withholding element displaceable along the rack by means of an adjusting element for preventing the pawl from engaging the rack, characterized by stroke limiting means controlled by the step width adjusting means so as to increase the stroke length of the actuating element when the step width increases and to decrease the stroke length of the actuating element when the step width decreases.

3 Claims, 3 Drawing Sheets

REPETITION PIPETTE

BACKGROUND OF THE INVENTION

The present invention relates to a repetition pipette.

German patent 29 26 691 discloses a repetition pipette in which the syringe receiving section is a U-shaped groove in a pipette housing into which a syringe flange can be inserted. In the receiving section the syringe flange is biased by a compression spring towards the delivery opening. The syringe piston includes a cylindrical actuating portion adapted to be fixed in the receiving member by clamping means. The piston returning means comprises a lever which extends from the receiving member through a lateral housing slot. The piston can be withdrawn from the syringe by moving the lever away from the syringe receiving portion. The actuating element of the piston advancing means is an actuating lever which is pivotally mounted on the side of the rack which does not include any toothing. The actuating lever includes the pawl and an actuating end extending from the housing on the toothing side of the rack. The withholding element of the step width adjusting means is a tongue which covers the toothing of the rack more or less depending on the settings of a rotary knob. The tongue prevents a pawl from engaging the rack upon actuation of the lever when the tongue is in the covering range. In the other range the pawl engages the toothing so as to drive the latter and the piston connected thereto for one advancing step. As a result the width of the advancing step and the volume dispensed by the syringe are adjustable by the rotary knob.

The stroke of the actuating lever includes an idle stroke portion for preventing the pawl from engagement with the toothing by the tongue, and a work stroke portion for having the pawl engage the toothing. The idle stroke portion is the greater and the work stroke portion the smaller, the smaller the adjusted step width and the smaller the liquid volume are. The user has to pivot the actuating lever through the idle stroke portion (which is substantial for many settings) even so this does not displace the piston within the syringe.

The problem to be solved by the invention is to provide a repetition pipette the handling of which is simplified.

SUMMARY OF THE INVENTION

The solution of this problem according to the present invention has been achieved by providing stroke limiting means controlled by the step width adjusting means so at increase the stroke length of the actuating element when the step width increase and to decrease the stroke length of the actuating element when the step width decreases.

The repetition pipette of the present invention includes stroke limiting means for limiting the stroke of the actuating element. The stroke limiting means is controlled by the step width adjusting means such that the stroke length is increased when the step width increases and is decreased when the step width decreases. It is ensured that the actuating element is moved always for the total work stroke while the idle stroke is reduced for all adjusted step widths. As a result the actuation serves always mainly or exclusively to have the actuating element perform the work stroke, i.e. to displace the syringe piston. This simplifies the handling and the handling expenditure is adapted to the respective dosage volume. The stroke length corresponds to the respective work distance so that it is a measure for the dosage volume and is an additional indication of the pipette setting for the user.

Preferably the stroke limiting means includes an abutment limiting the stroke of the actuating element at the begining, which abutment is adjustable by the step width adjusting means both in the advancing and returning direction of the actuating element. For compensation of an increase of the idle stroke the abutment is adjusted in the advancing direction of the actuating element when the step width decreases. When the step width increases to provide for increased volumes of the dispensed liquid, the abutment is displaced in the returning direction of the actuating element so that a sufficient work stroke and, if desired, a predetermined idle stroke are available.

Preferably the abutment comprising a shoulder of the withholding element is displaceable along the rack so as to provide for a practically constant idle stroke. The actuation stroke is decreased or increased corresponding to the work stroke adjusted by means of the withholding element. Preferably the abutment is positioned so as to be spaced from a forward end of the withholding element. Upon actuation the pawl can cooperate with the withholding element for a certain idle stroke before it engages into the toothing.

The withholding element can be a sleeve guided along the rack. Preferably, the abutment is a lateral shoulder of the sleeve.

According to a further development of the invention the actuating element extends transversely across one side of the rack. Furthermore, the withholding element may include the shoulder on this side of the rack. The actuating element may include a pair of parallel legs on opposite sides of the rack, and the withholding element may include the shoulders on both sides. Furthermore the actuating element may include a pivot mount on each side of the rack and an actuation end on the other side of the rack.

Finally, the invention provides that said withholding element includes a laterally projecting guide cam which is guided in a cam guide of an adjusting knob. This adjusting means of the withholding element is particularly advantageous when it is arranged to cause, at the same time, displacements of the abutment.

The rack may be a rod including a toothing; as an alternative it may be formed as a threaded rod or as a rod including circumferential grooves.

BRIEF DESCRIPTION OF THE DRAWINGS

Further details and advantageous of the invention may be seen from the following description of the accompanying drawings with reference to a prefered embodiment. In the drawings.

DETAILED DESCRIPTION OF THE PREFERED EMBODIMENT

Figure 1:
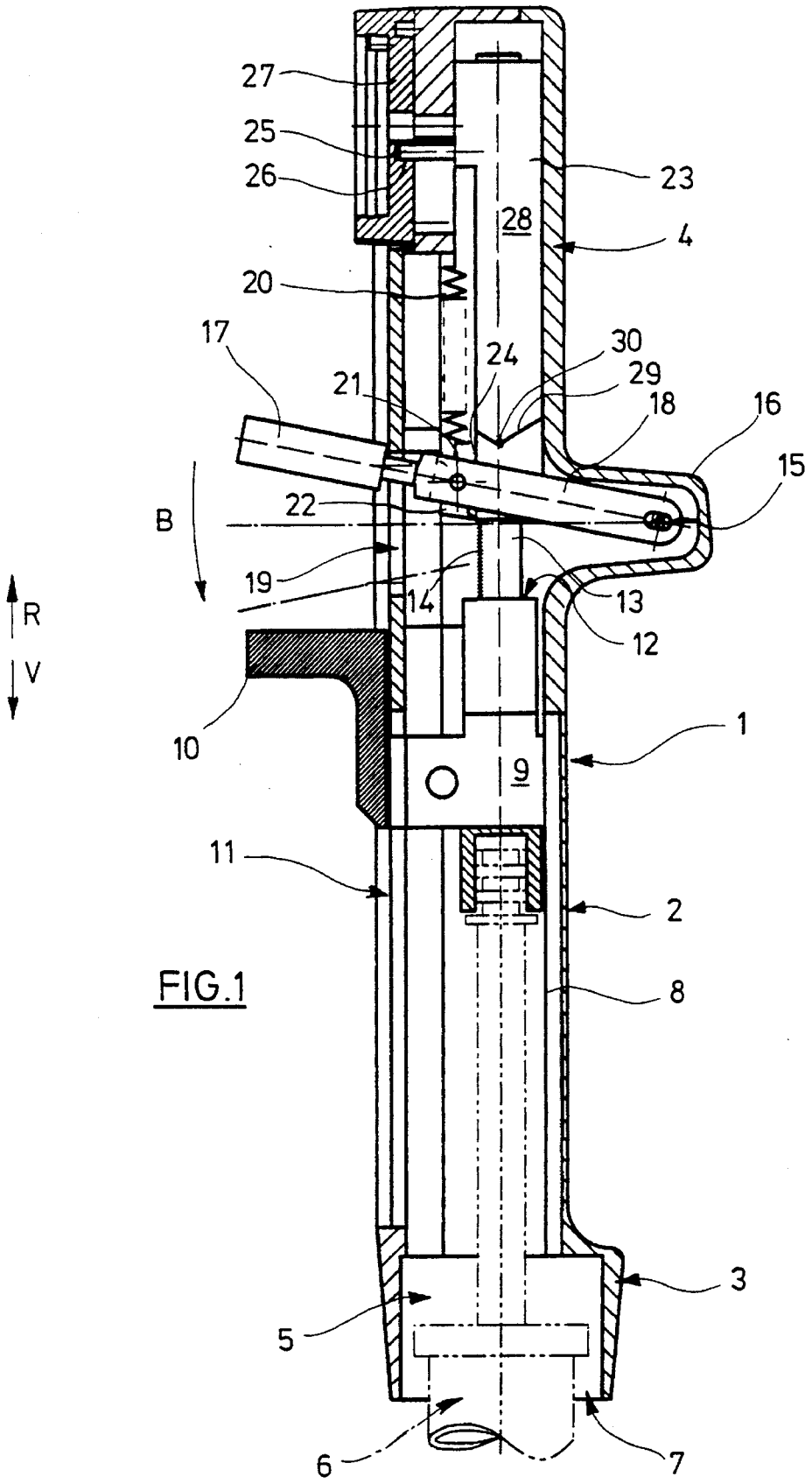
FIG. 1 is a longitudinal section of a repetition pipette including stroke limiting means.

The repetition pipette includes a housing 1 which has a middle portion 2 formed as a handle, a foot portion 3 and a head portion 4. The foot portion 3 includes a syringe receiving section 5 for a syringe flange of a syringe 6 which is partially indicated by dash dotted lines. Furthermore the foot portion 3 is provided with an endwise inlet opening 7 for the syringe body.

The middle portion 2 has internally a guide 8 which slidingly receives a receiving member 9 for the actuating end of the syringe piston. The receiving member 9 includes— not shown—clamping means by which the inserted actuated end can be fixed.

Furthermore the receiving member 9 includes a returning lever 10 extending from a slot 11 in the left hand side of the housing.

The receiving member 9, at its face 12 remote from the receiving section 5, carries a rack 13 which extends through the middle portion 2 to the head portion 4 of the housing 1. The rack 13 has a flat cross-section which is provided with a saw-tooth-shaped toothing 14 along one narrow side. The steeper flank of the toothing 14 is facing the head portion 4.

In the head portion 4 an actuating lever 17 is pivotally mounted on an axis 15 in a formation 16 on one side of the housing. The actuating lever 17 includes a pair of parallel legs 18, 18' and has an actuating end project from a slot 19 in the opposite side of the housing. Between the actuating lever 17 and the housing 1 a traction spring 20 acts to bias the actuating lever towards the head portion 4.

On the side of the rack 13 opposite its axis 15 the actuating lever 17 pivotally mounts a pawl 22 on a pin 21 between its legs 18, 18'; as shown in FIG. 1 the pawl 22 has its engaging end engage into the toothing 14. The pawl 22 is biased towards the rack 13 by means of a—not shown—leg spring supported against the pawl and the actuating lever 17.

A withholding element 23 which is formed as a sleeve extends from the head portion 4 to the rack 13. The sleeve 23 has a withholding surface 24 cover a part of the toothing 14. It is displaceable along the rack 13. To this end it includes a pin 25 adjacent its end facing away from the rack 13; the pin 25 engages into a cam surface 26 of a rotary knob 27 mounted to the head portion 4. The position of the sleeve 23 in the housing 1 and the extent for which it covers the toothing 14 can be adjusted by rotary movements of the rotary knob 27.

The sleeve 23 has at its lateral surfaces 28, 28' outwardly projecting shoulders 29, 29'. The shoulders 29, 29' form abutments for the parallel legs 18, 18' of the lever 18 which receive between them the sleeve 23 and, respectively, the rack 13. The shoulders 29, 29' include tapers 30, 30' towards the lever 17 so as to ensure positive engagement of the legs 18, 18'.

Figure 2:
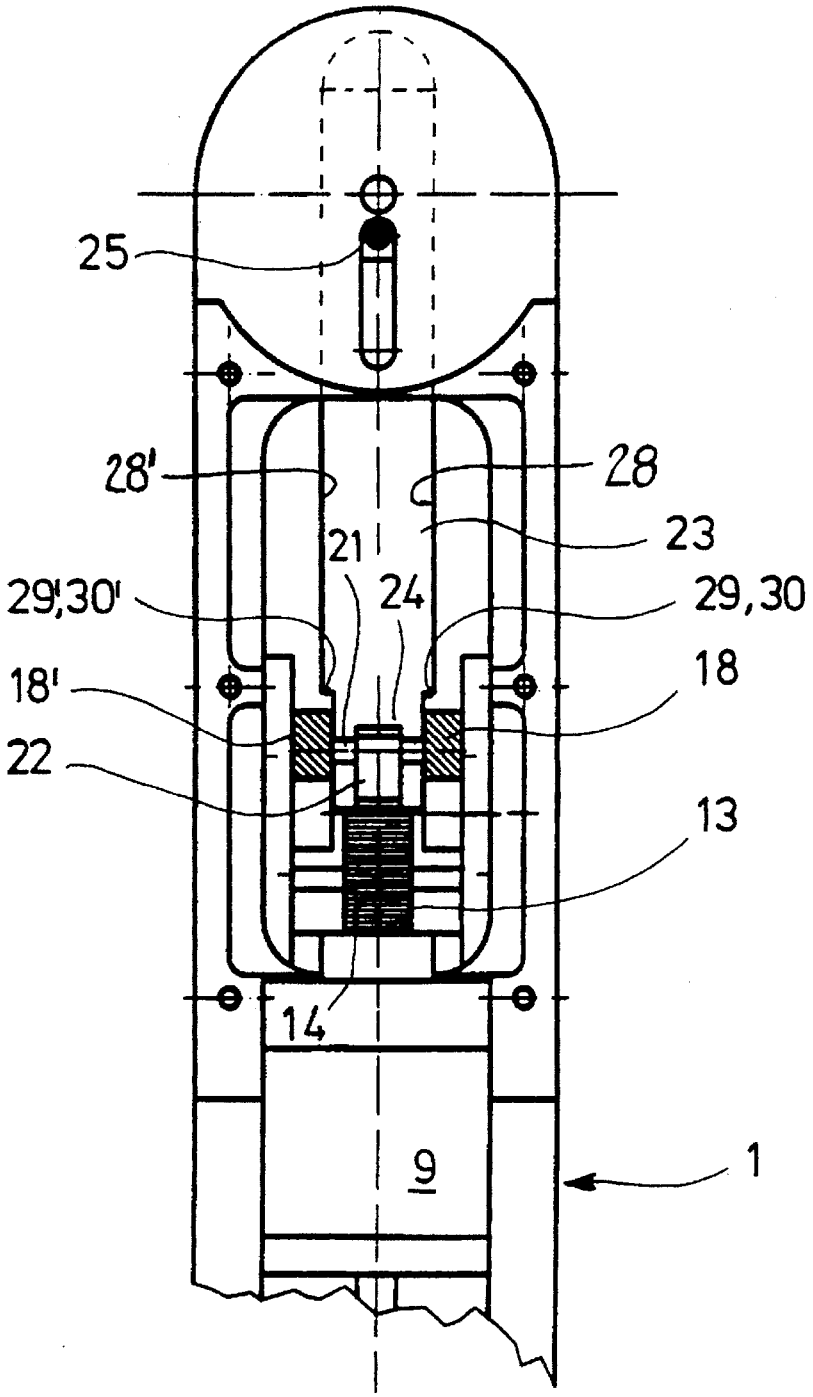
FIG. 2 is a partial section transverse to the longitudinal section of FIG. 2 of the same repetition pipette.
Figure 3:
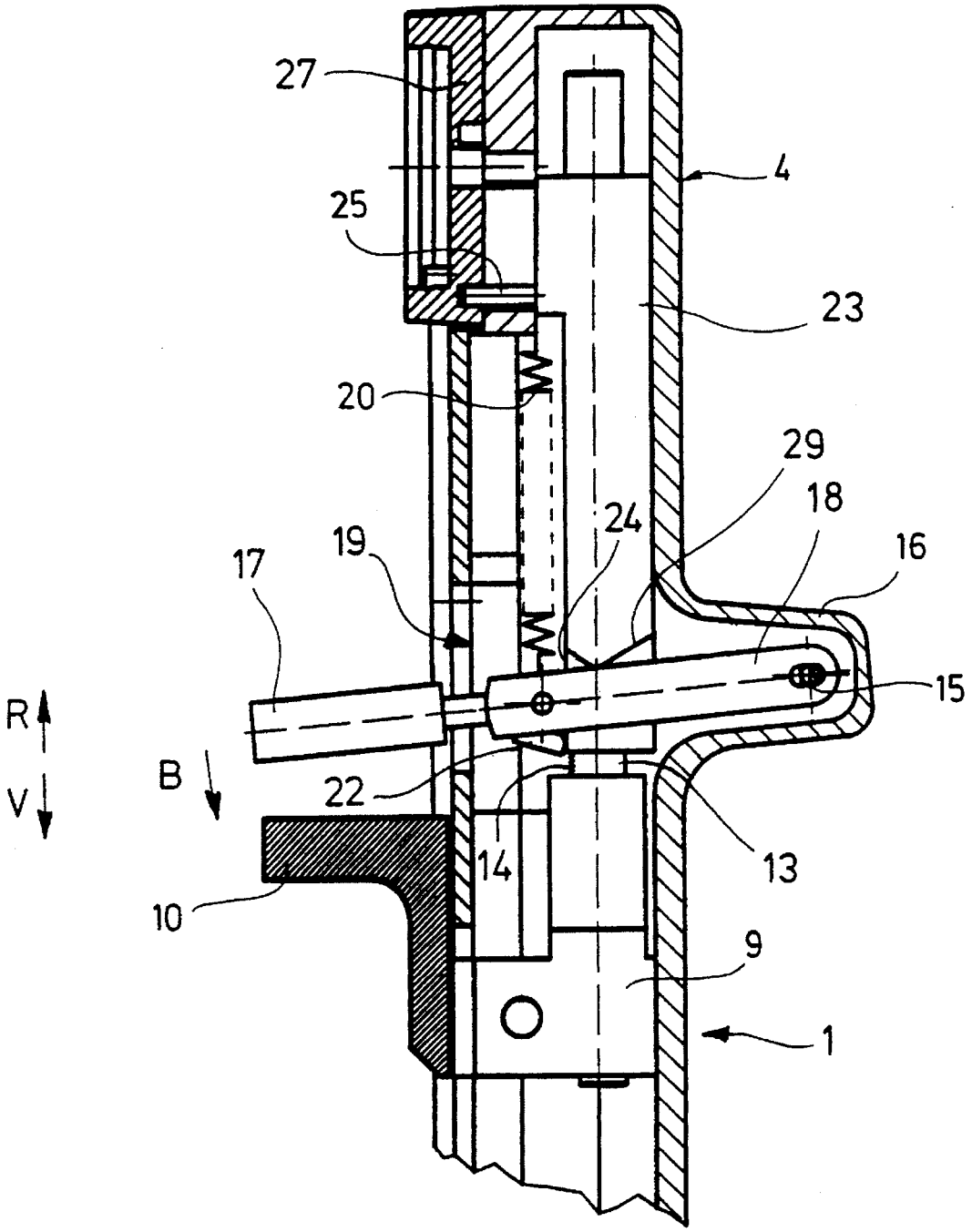
FIG. 3 is a partial longitudinal section of the same repetition pipette with a decreased work stroke to more clearly show the stroke limiting means.

The repetition pipette operates as follows:

Initially a syringe 6 is moved through the inlet opening 7 so that its flange is inserted in the syringe receiving section 5 and its actuating end is inserted in the receiving member 9. By not shown clamping means it is fixed within the syringe receiving section 5 and the receiving member 9. For loading the syringe 6 the receiving member 9 can be displaced in a rearward direction R by means of the returning lever 10. FIGS. 1 to 3 show the repetition pipette with its retracted receiving member 9 in a position ready for dispensing liquid.

In FIGS. 1 and 2 the sleeve 23 has been maximally retracted in the returning direction R by means of the rotary knob 27. The actuating lever 17 has been pivoted in the rearward direction by the traction spring as far as it is enabled by the slot 19 in the housing 1. The pawl 22 is still supported against the withholding surface 24 of the sleeve 23. When the actuating lever 17 is actuated, the pawl 22 engages via the forward end of the sleeve 23 directly into the toothing 14 so as to drive the rack 13 in the advancing direction V. Substantially the complete actuation stroke B of the actuating lever 17 is used as work stroke for driving the rack 13 and the dosing of liquid. After the actuating lever 17 has been released it is automatically returned under the influence of the traction spring 20 to the shown original position, with the pawl 22 being disengaged from the toothing 14. The pipette is know ready for a further dosing step.

In FIG. 3 the sleeve 23 has been displaced maximally across the toothing 13 by adjustment of the rotary knob 27. Only four teeth of the toothing 14 are accessible to be engaged by the pawl 22. The actuating lever 17 has its legs 18, 18' engage the shoulders 29, 29' of the sleeve 23 so as to be urged in the advancing direction V. The spacing of the abutments 29, 29' from the forward end of the sleeve 23 is dimensioned such that the pawl 22 is supported upon the withholding surface 24 in spaced relationship to its forward end corresponding to an idle stroke. When the actuating lever 17 is actuated initially the pawl 22 slides across the withholding surface 24 and is prevented thereby from engagement with the toothing so as to perform an idle stroke. The remaining part of the actuation stroke B is accompanied by engagement of the pawl into the toothing 14 so as to be used as work stroke. A comparison with FIG. 1 shows that adjusting a smaller step width results in a substantially reduced actuation stroke B.

Adjustments between the shown extreme positions cause the actuation stroke to be changed proportionally to the work stroke. The idle stroke is substantially constant—as long as the lever 17 is not retained by the limitation of the slot 19—and is determined by the spacings of the abutments 29, 29' from the forward end of the sleeve 23.

We claim:

1. A repetition pipette including a syringe receiving section (5) for a mounting portion of a syringe (6), a receiving member (9) having a piston receiving portion for the mounting portion of a syringe piston, piston returning means (10) for moving said receiving member away from said syringe receiving section, piston advancing means (13, 17, 22) for advancing said receiving member towards said piston receiving portion, the piston advancing means comprising a rack having a toothing (13) connected to said receiving member, and an actuating element (17) movable along an actuation path (B), and a pawl (22) pivotally mounted thereto, said pawl being movable into engagement with the toothing (14) of the rack so as to drive the rack for an advancing step when the actuating element is advanced, and is moved out of engagement with the rack when the actuating element is returned, means (23,27) for adjusting a step width of the advancing step, the step width adjusting means comprising a sleeve-shaped withholding element (23) displaceable along the rack by an adjusting element (27) for preventing the pawl from engaging the rack, and stroke length limiting means (29,29') controlled by the step width adjusting means (23,27) so as to increase a stroke length (B) of the actuating element (17) when the step width increases and to decrease the stroke length of the actuating element when the step width decreases;

wherein said stroke length limiting means includes an abutment (29,29') limiting the stroke length (B) of the actuating element (17) at the beginning of the stroke length, said abutment being adjustable by the step width adjusting means (23,27) both in an advancing and a returning direction (V and R) of the actuating element;

wherein the withholding element (23) comprises a lateral shoulder (29,29') forming said abutment; and wherein said actuating element (17) includes a pair of parallel legs, (18,18') with one leg extending transversely across one side of said rack (13), and the withholding element (23) has said shoulder (29) on said one side of the rack (13).

2. A pipette according to claim 1, wherein said actuating element (17) includes a pivot mount (15) on one side of the rack (13) and an actuating end on the other side of the rack.

3. A pipette according to claim 1, wherein said withholding element (23) includes a laterally projecting guide pin (25) which is guided in a cam surface (26) of an adjusting knob (27).

* * * * *